US006140894A

United States Patent [19]

Lane

[11] Patent Number: 6,140,894

[45] Date of Patent: Oct. 31, 2000

[54] ELECTRICAL CIRCUIT BREAKERS

[75] Inventor: Stephen Ernest Lane, Manchester, United Kingdom

[73] Assignee: FKI PLC, Halifax, United Kingdom

[21] Appl. No.: 09/202,410

[22] PCT Filed: Jul. 4, 1997

[86] PCT No.: PCT/GB97/01805

§ 371 Date: Dec. 14, 1998

§ 102(e) Date: Dec. 14, 1998

[87] PCT Pub. No.: WO98/01883

PCT Pub. Date: Jan. 15, 1998

[51] Int. Cl.[7] ..... H01H 75/00

[52] U.S. Cl. ..... 335/16; 335/142; 335/195; 218/22

[58] Field of Search ..... 335/16, 147, 195; 218/22, 33, 154

[56] References Cited

U.S. PATENT DOCUMENTS

| | | | |
|---|---|---|---|
| 3,366,900 | 1/1968 | Barkan | 335/16 |
| 3,550,049 | 12/1970 | Blanc-Tailleur . | |
| 3,582,587 | 6/1971 | Barkan | 218/22 |
| 3,614,353 | 10/1971 | Yoshio | 335/16 |
| 4,025,886 | 5/1977 | Barkan et al. | 335/195 |
| 4,032,870 | 6/1977 | Oppel et al. | 218/22 |
| 4,153,827 | 5/1979 | Mircovich et al. . | |
| 4,656,444 | 4/1987 | McKee et al. . | |

*Primary Examiner*—Lincoln Donovan
*Attorney, Agent, or Firm*—Nikolai, Mersereau & Dietz PA

[57] ABSTRACT

An electrical circuit breaker includes a moveable contact piece connected to an actuating means and provided with a contact face arranged to make contact with a contact face of a second contact piece by movement of the moveable contact piece generally in a first direction. The circuit breaker further includes an electrical connector for conveying current to the moveable contact piece which includes at least two adjacent limbs adapted to convey the current in opposing directions so as to generate an electromagnetic force repelling the adjacent limbs from one another, which force is used to assist in maintaining the contact faces in abutment. The outermost limbs bear, respectively, upon a reaction end face of the actuating means and the moveable contact piece, and the moveable contact piece is connected to the actuating means by a connecting rod displaceable relative to the actuating means and biased in the first direction so as to form a snatch gap between the actuating means and the connecting rod when the first and second contact pieces are closed, the electromagnetic force thereby assisting in accelerating closure of the snatch gap during a contact opening operation.

32 Claims, 2 Drawing Sheets

ELECTRICAL CIRCUIT BREAKERS

BACKGROUND OF THE INVENTION

This invention relates to electrical circuit breakers and, more particularly, to electrical circuit breakers including a flexible electrical connector connected to a moving contact piece having a contact face arranged to make or break contact with a contact face on a relatively fixed contact piece to make or break an associated electrical circuit the respective contact faces extending generally perpendicular to the direction of movement of the moving contact piece.

One of the main considerations in the design of any circuit breaker is to ensure that sufficient pressure is applied to the current carrying contact faces by contact loading springs, in order to avoid welding together of the contact faces during a fault condition in the associated circuit. When an overload fault current flows through the contact faces a large amount of heat is produced. Dependent upon the design and type of contacts used and particularly with butt type contacts employed in vacuum interrupters there is usually a "blow-open" force involved. This is the electromagnetic force created by the fault current which tends to act to urge apart the contact faces, reducing the contact pressure, which increases the resistance and leads to further heating or even initial contact face separation and arcing. This heating or arcing can cause welding together of the contact faces. If welding occurs the circuit breaker opening mechanism will experience difficulty in separating the contact faces after the passage of a fault current and even may fail to interrupt the fault current.

SUMMARY OF THE INVENTION

According to one aspect, the present invention provides an electrical circuit breaker including a moveable contact piece connected to an actuating means and provided with a contact face arranged to make contact with a contact face of a second contact piece by movement of the moveable contact piece generally in a first direction, the circuit breaker further including an electrical connector for conveying current to the moveable contact piece, said electrical connector including at least two adjacent limbs adapted to convey said current in substantially opposing directions so as to generate an electromagnetic force repelling said adjacent limbs from one another which force is used to assist in maintaining the contact faces in abutment.

According to another aspect, the present invention provides an electrical circuit breaker including a moveable contact piece connected to an actuating means and provided with a contact face arranged to make or break contact with a contact face provided on a substantially fixed contact piece to make or break an associated electrical circuit, the respective contact faces extending perpendicular, or substantially perpendicular, to the direction of movement of the moveable contact piece wherein a flexible electrical connection extending from a fixed conductor to the moveable contact piece is formed as a sinuous strip having planar limbs connected one to another by a return bend with the planar limbs extending substantially perpendicular to the direction of movement of the moveable contact piece to generate electro-magnetically a force acting to repel one planar limb from an adjoining planar limb in the direction of movement of the moveable contact piece upon an electric current flowing through the flexible electric connection, the force being arranged to act between the moveable contact piece and the actuating means in a direction urging the contact faces into abutment.

Preferably, the flexible electrical connection is formed as a sinuous strip having at least three planar limbs connected by return bends. The outermost planar limbs may be of rigid construction whilst the intermediate limb or limbs and return bends are of resilient construction.

DETAILED DESCRIPTION

Figure 1:
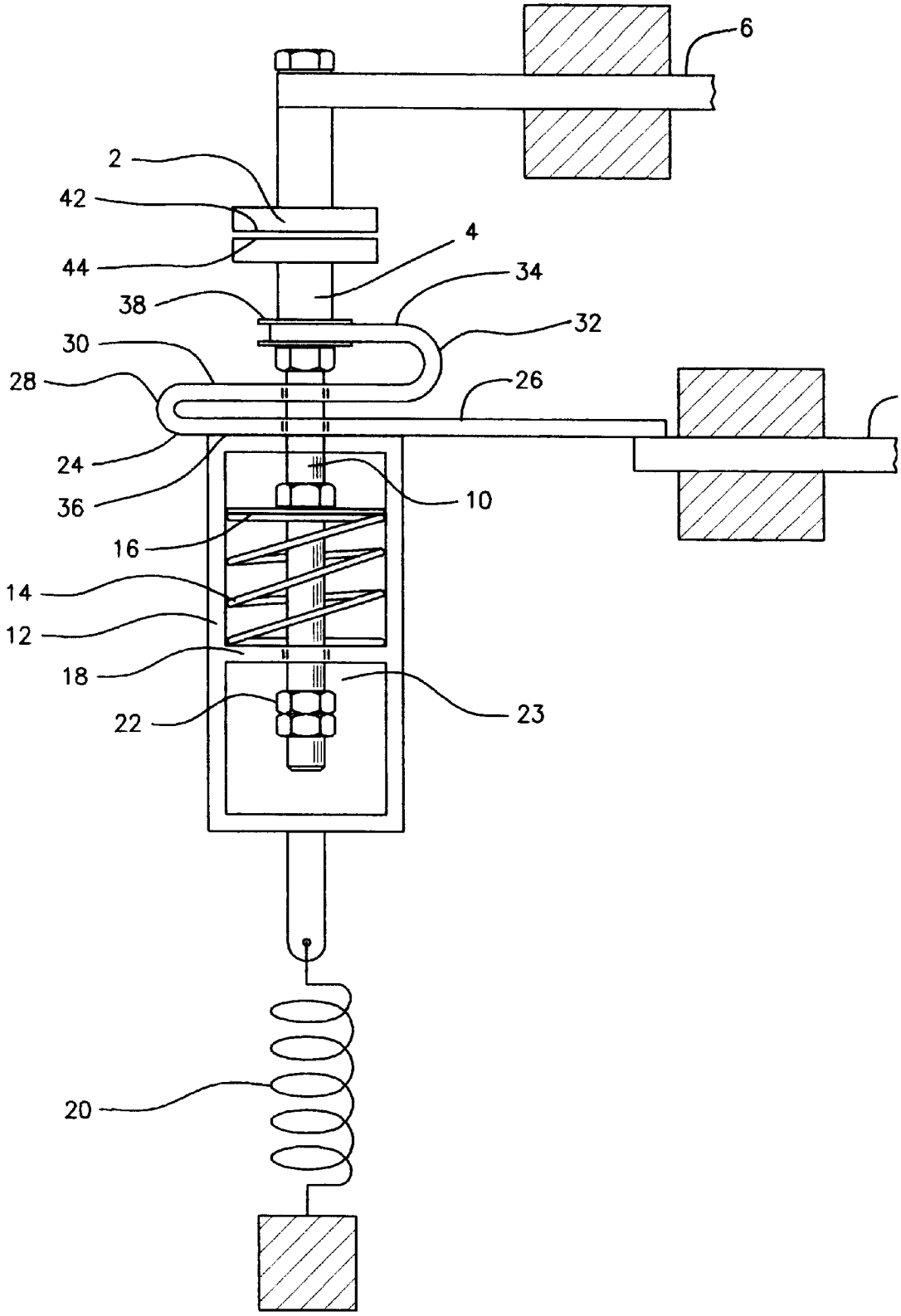
FIG. 1 is a side elevational view, partially in diagramatic or schematic form showing essential workings of the electrical circuit breaker of the invention.

As shown in the accompanying, partly diagrammatic drawing, in one embodiment of the invention an electrical circuit breaker, which may be housed in a gas-tight envelope, as, for example, an alternating current vacuum interrupter, includes a fixed contact piece 2 and a moveable contact piece 4 together with respective associated fixed conductors 6,8. The moveable contact piece includes an actuating rod 10 positioned in an actuating cylinder 12 carried in guide means (not shown) and mechanically linked to an actuating mechanism (not shown). (It will be understood that a saddle or yoke arrangement may be substituted for the actuating cylinder 12.) A compression spring 14 acts between a shoulder 16 on the actuating rod 10 and a flange 18 in the actuating cylinder 12 to urge the moveable contact piece 4 toward the fixed contact piece 2. A tension spring 20 biases the actuating cylinder 12 in a direction away from the fixed contact piece 2. Movement of the actuating cylinder 12 in a direction away from the fixed contact piece 2 is transmitted through the flange 18 to a nut 22 threaded on to the actuating rod 10 and spaced slightly from the flange 18 forming a snatch gap 23 therebetween under normal electric current flow conditions.

A flexible strip electric connection 24 includes a first limb 26 connected to the fixed conductor 8 and, by a return bend 28, to a second limb 30. The second limb 30 is connected, by a return bend 32, to a third limb 34 secured to the moveable contact piece 4. The first, second and third limbs 26, 30 and 34 are apertured to accommodate the actuated rod 10 and, at least the first and third limbs 26, 34, may have an enhanced rigidity compared with the return bends 28, 32. The first limb 26 bears against a reaction end face 36 of the actuating cylinder 12 and the third limb bears against a washer 38 on the moveable contact piece 4.

In operation, with respective contact faces 42, 44 on the fixed and moveable contact pieces 2, 4 in abutment, electrical current flows between the fixed conductors 6, 8 through the fixed and moveable contact pieces 2, 4 and the flexible connection 24. The electric current flow through adjacent limbs 26, 30, 34 of the flexible connection 24 is in opposed directions such that the electromagnetic forces generated by the current flow act to repel the first limb 26 away from the second limb 30 and the second limb 30 away from the third limb 34. These repulsion forces augment the force exerted by the compression spring 14 to maintain the contact faces 42, 44 in contact. Upon an overload occurring in the electrical circuit, the actuator mechanism is actuated rapidly to move the actuating cylinder 12 and, in turn, following the flange 18 abutting the nut 22, the moveable contact piece 4 away from the fixed contact piece 2 to interrupt the current flow. Since the reaction end face 36 of the actuating cylinder 12 is moved away from the fixed contact piece 2 the distances between the limbs increases so that the effects of the electromagnetic repulsion forces generated in the limbs 26, 30, 34 decrease and no longer act to impede the opening motion of the moveable contact piece 4. As current flow between the two contact surfaces 42, 44 is broken, current flow in the limbs 26, 30, 34 ceases so that the repulsion electromagnetic forces fall to zero and thus do not oppose subsequent re-closing of the contact surfaces 42, 44 by way of the actuating mechanism moving the actuating cylinder 12 toward the fixed contact piece 2. However, once the contact surfaces 42, 44 have re-closed the repulsion electromagnetic forces are re-established to generate an additional contact loading force.

Since the arrangement enhances the manner of separation of the contact surfaces 42,44 any propensity for arcing to arise or welding to occur is substantially mitigated.

This permits much lighter, cheaper mechanisms and lower rated control supplies to be employed in the design of circuit breakers with high short circuit rated equipment.

In addition, it is noted that during the opening of the circuit breaker by the actuator, the reaction end face 36 of the actuating cylinder 12 is moved away from the fixed contact piece 2 initially with the assistance of the electromagnetic repulsion forces generated by the flexible strip electrical connection 24. The effect of this repulsion force is to assist springs 20 and 14 in accelerating the cylinder 12 until flange 18 strikes the nut 22 which acts as an impulse force operative to separate the main contact faces 42, 44 and break any slight welding of the contact faces which may have occurred as a result of excessive current flow. Once the snatch gap 23 between flange 18 and nut 22 is closed, the electromagnetic forces and contact pressure spring 14 cease to play a part in the opening motion (they simply attempt to stretch the actuating rod 10) and the opening spring 20 completes the opening of contact pieces 2 and 4.

Another application of this type of flexible connection is in direct acting instantaneous trips as fitted to direct current circuit breakers for instance. In this application the repulsive forces are used to apply additional contact pressure up to the point when the direct acting trip is required to operate. The forces act against the moving contact and the actuator holding force until the current reaches a value where the force is sufficient to overcome the mechanical or magnetic holding or latching force, thereby tripping the circuit breaker.

Figure 2:
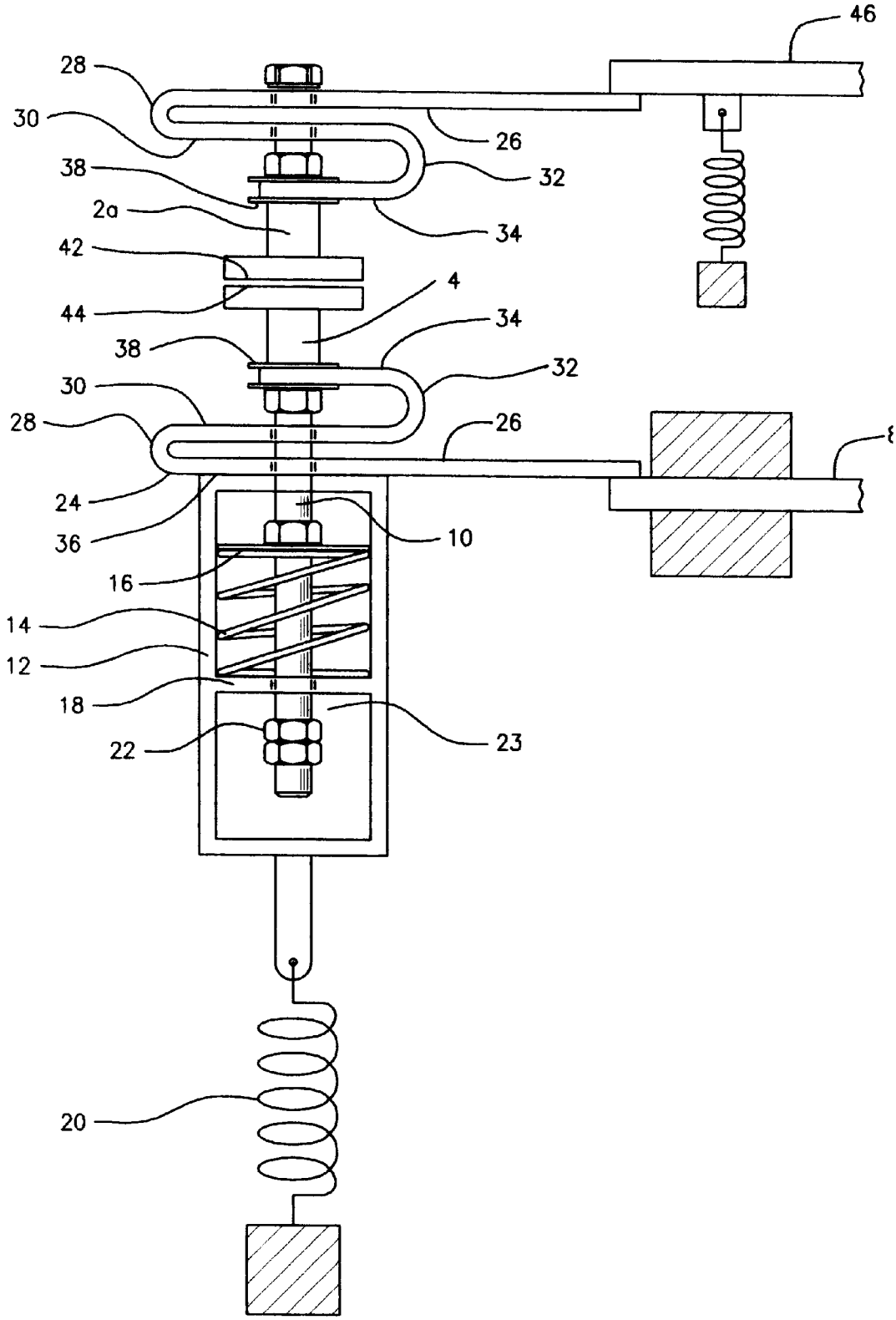
FIG. 2 depicts an alternative embodiment to that of FIG. 1.

In an alternative arrangement (shown in FIG. 2) particularly applicable to a direct current circuit breaker both contact pieces 4,2 are arranged to be moveable with one of the contact pieces 4 connected to an actuating mechanism 12 and the other contact piece connected to a spring loaded mounting 46. A flexible electric connection 24 is provided for each contact piece and serves to assist tripping of the circuit breaker as described in the preceding paragraph.

Whilst a flexible electric connection 24 with three planar limbs has been described, it will be appreciated that other configurations may be utilised in which the electric current is arranged to flow in opposed adjacent limbs having a sufficient active length as to generate a requisite electromagnetic force to achieve the force required for maintaining the contact faces 42, 44 in abutment.

It will also be understood that the electrical connection 24 need not be achieved with a flexible strip. In general, any electrical connection which includes two adjacent limbs adapted to convey the current in substantially opposing directions so as to generate an electromagnetic force repelling the adjacent limbs from one another could be used. Rigid limbs connected at one end by a hinge could also be used.

What is claimed is:

1. An electrical circuit breaker including a moveable contact piece, a second contact piece and a linear actuating device, said moveable contact piece being connected to be moved by said actuating device and provided with a contact face arranged to make contact with a contact face of the second contact piece by movement of the moveable contact piece in a first direction, the circuit breaker further including an electrical connector for conveying current to the moveable contact piece, said electrical connector including at least two adjacent limbs adapted to convey said current in opposing directions so that current conducted in said adjacent limbs generates an electromagnetic force repelling said adjacent limbs from one another which force is used to assist in maintaining the contact faces in abutment, wherein:

(a) the outermost of said at least two adjacent limbs bear, respectively, upon a reaction end face of the actuating device and the moveable contact piece;

(b) the device includes a connecting rod connected to said moveable contact piece and carrying a pair of spaced stops located to be moved by said actuating device, said stops being spaced relative to said actuating device such that said actuating device is displaceable for a distance in a second direction relative to the connecting rod and biased in the first direction so as to form a snatch gap between the actuating device and one of the stops of the connecting rod when the first and second contact pieces are closed; and (c) the electromagnetic force repelling said outermost limbs operating to assist separation forces when said actuating device is moved in said second direction causing the actuating device to accelerate toward said one of said stops to assist in closure of the snatch gap during a contact opening operation by said actuating device.

2. An electrical circuit breaker according to claim 1 in which the electrical connector is a flexible strip having at least two limbs connected one to another by a return bend.

3. An electrical circuit breaker according to claim 2 in which each of the limbs extends substantially perpendicular to the first direction.

4. An electrical circuit breaker according to claim 3 in which the electrical connector is formed as a sinuous strip having at least three limbs connected by return bends.

5. An electrical circuit breaker according to claim 4 in which the outermost planar limbs are of rigid construction, whilst the intermediate limb or limbs and return bends are of resilient construction.

6. An electrical circuit breaker according to claim 1 in which the contact faces each extend substantially perpendicular to the first direction.

7. An electrical circuit breaker according to claim 1 in which the actuating device includes means for providing a predetermined holding force to said moveable contact in the first direction and a trip threshold which, when force opposite to said first direction exceeds the trip threshold, causes said contacts to open, said force opposite to said first direction being provided by the electrical connector when a predetermined current threshold is exceeded.

8. An electrical circuit breaker according to claim 1 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

9. An electrical circuit breaker according to claim 1 in which the adjacent limbs of the electrical connector or electrical connectors have sufficient active length so as to generate a requisite electromagnetic force to achieve the force required for maintaining the contact faces in abutment.

10. An electrical circuit breaker according to claim 2 in which the contact faces each extend substantially perpendicular to the first direction.

11. An electrical circuit breaker according to claim 3 in which the contact faces each extend substantially perpendicular to the first direction.

12. An electrical circuit breaker according to claim 4 in which the contact faces each extend substantially perpendicular to the first direction.

13. An electrical circuit breaker according to claim 5 in which the contact faces each extend substantially perpendicular to the first direction.

14. An electrical circuit breaker according to claim 2 in which the actuating device includes means for providing a predetermined holding force to said moveable contact in the first direction and a trip threshold which, when force opposite to said first direction exceeds the trip threshold, causes said contacts to open, said force opposite to said first direction being provided by the electrical connector when a predetermined current threshold is exceeded.

15. An electrical circuit breaker according to claim 3 in which the actuating device includes means for providing a predetermined holding force to said moveable contact in the first direction and a trip threshold which, when force opposite to said first direction exceeds the trip threshold, causes said contacts to open, said force opposite to said first direction being provided by the electrical connector when a predetermined current threshold is exceeded.

16. An electrical circuit breaker according to claim 4 in which the actuating device includes means for providing a predetermined holding force to said moveable contact in the first direction and a trip threshold which, when force opposite to said first direction exceeds the trip threshold, causes said contacts to open, said force opposite to said first direction being provided by the electrical connector when a predetermined current threshold is exceeded.

17. An electrical circuit breaker according to claim 5 in which the actuating device includes means for providing a predetermined holding force to said moveable contact in the first direction and a trip threshold which, when force opposite to said first direction exceeds the trip threshold, causes said contacts to open, said force opposite to said first direction being provided by the electrical connector when a predetermined current threshold is exceeded.

18. An electrical circuit breaker according to claim 6 in which the actuating device includes means for providing a predetermined holding force to said moveable contact in the first direction and a trip threshold which, when force opposite to said first direction exceeds the trip threshold, causes said contacts to open, said force opposite to said first direction being provided by the electrical connector when a predetermined current threshold is exceeded.

19. An electrical circuit breaker according to claim 2 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

20. An electrical circuit breaker according to claim 3 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

21. An electrical circuit breaker according to claim 4 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

22. An electrical circuit breaker according to claim 5 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

23. An electrical circuit breaker according to claim 6 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

24. An electrical circuit breaker according to claim 7 in which said second contact piece is moveable in a direction opposite to said first direction and includes a second electrical connector for conveying current to the second contact piece, said second electrical connector including at least two adjacent limbs adapted to convey said current in substantially opposing directions so as to generate an electromagnetic force repelling said adjacent limbs from one another which force is also used to assist in maintaining the contact faces in abutment.

25. An electrical circuit breaker according to claim 2 in which the adjacent limbs of the electrical connector or electrical connectors have sufficient active length so as to generate a requisite electromagnetic force to achieve the force required for maintaining the contact faces in abutment.

26. An electrical circuit breaker according to claim 3 in which the adjacent limbs of the electrical connector or electrical connectors have sufficient active length so as to generate a requisite electromagnetic force to achieve the force required for maintaining the contact faces in abutment.

27. An electrical circuit breaker according to claim 4 in which the adjacent limbs of the electrical connector or electrical connectors have sufficient active length so as to generate a requisite electromagnetic force to achieve the force required for maintaining the contact faces in abutment.

28. An electrical circuit breaker according to claim 5 in which the adjacent limbs of the electrical connector or electrical connectors have sufficient active length so as to generate a requisite electromagnetic force to achieve the force required for maintaining the contact faces in abutment.

29. An electrical circuit breaker according to claim 6 in which the adjacent limbs of the electrical connector or electrical connectors have sufficient active length so as to generate a requisite electromagnetic force to achieve the force required for maintaining the contact faces in abutment.

30. An electrical circuit breaker according to claim 7 in which the adjacent limbs of the electrical connector or electrical connectors have sufficient active length so as to generate a requisite electromagnetic force to achieve the force required for maintaining the contact faces in abutment.

31. An electrical circuit breaker according to claim 8 in which the adjacent limbs of the electrical connector or electrical connectors have sufficient active length so as to generate a requisite electromagnetic force to achieve the force required for maintaining the contact faces in abutment.

32. The circuit breaker of claim 1 wherein said stops are moveable relative to each other to adjust said snatch gap.

* * * * *